US008020485B2

(12) United States Patent
Jessen et al.

(10) Patent No.: US 8,020,485 B2
(45) Date of Patent: Sep. 20, 2011

(54) LIFTING GEAR VALVE ARRANGEMENT

(75) Inventors: Soenke Jessen, Tamm (DE); Gerhard Keuper, Leonberg (DE); Heinrich Loedige, Vaihingen (DE); Reiner Kunz, Sachsenheim (DE)

(73) Assignee: Bosch Rexroth AG, Stuttgart (DE)

( * ) Notice: Subject to any disclaimer, the term of this patent is extended or adjusted under 35 U.S.C. 154(b) by 511 days.

(21) Appl. No.: 11/571,730

(22) PCT Filed: Jul. 6, 2005

(86) PCT No.: PCT/EP2005/007308
§ 371 (c)(1),
(2), (4) Date: Jul. 30, 2007

(87) PCT Pub. No.: WO2006/005496
PCT Pub. Date: Jan. 19, 2006

(65) Prior Publication Data

US 2007/0277519 A1 Dec. 6, 2007

(30) Foreign Application Priority Data

Jul. 9, 2004 (DE) ..... 10 2004 033 315

(51) Int. Cl.
*F15B 11/028* (2006.01)

(52) U.S. Cl. ..... 91/435; 91/446; 91/451

(58) Field of Classification Search ..... 91/451, 91/435, 361
See application file for complete search history.

(56) References Cited

U.S. PATENT DOCUMENTS

| | | | | |
|---|---|---|---|---|
| 4,898,078 | A * | 2/1990 | Gage et al. | 91/524 |
| 5,186,000 | A | 2/1993 | Hirata et al. | |
| 5,315,828 | A | 5/1994 | Stellwagen et al. | |
| 5,855,159 | A * | 1/1999 | Yoshida et al. | 91/451 |
| 6,405,633 | B1 * | 6/2002 | Dueckinghaus et al. | 91/451 |
| 2003/0205128 | A1 * | 11/2003 | Zenker et al. | 91/446 |

FOREIGN PATENT DOCUMENTS

| | | |
|---|---|---|
| DE | 41 35 013 A1 | 4/1993 |
| DE | 44 33 633 C1 | 12/1995 |
| DE | 19939967 | 10/2003 |
| EP | 0 341 650 A | 11/1989 |
| EP | 0 438 604 A | 7/1991 |
| EP | 1 069 317 A | 1/2001 |

OTHER PUBLICATIONS

Mannesmann Rexroth; "High Pressure Load-Sensing Control Block Type M4-15, Series 1X in Asandwich Plate Design", Mannesmann Resroth RE 64 282/01.97, 1997, pp. 1-20, XP001027942.

* cited by examiner

*Primary Examiner* — Daniel Lopez
(74) *Attorney, Agent, or Firm* — Boyle Fredrickson, S.C.

(57) ABSTRACT

Disclosed is a lifting gear valve arrangement for controlling a double-action lifting gear or an add-on unit with a continuously adjustable directional control valve and with an individual pressure compensator via which a pressure medium volume flow to and from a lifting cylinder of the lifting gear can be controlled. A proportionally adjustable pressure limiting valve is provided in the pressure medium flow path between an outlet connection of the directional control valve and a working connection of the lifting gear valve arrangement, via which the pressure inside this area can be limited to a maximum value. The adjustment of the pressure limiting valve is preferably performed as a function of the operating states of the lifting gear or of the type of add-on unit.

20 Claims, 6 Drawing Sheets

LIFTING GEAR VALVE ARRANGEMENT

BACKGROUND OF THE INVENTION

1. Field of the Invention

The invention relates to a lifting gear valve arrangement for controlling a double-action lifting gear or an add-on unit of a mobile implement.

2. Description of Related Art

In modern tractors of the medium and upper performance classes, electrically controllable directional control valves have increasingly been used in work hydraulics for controlling the work functions of coupled devices. The control of these hydraulic functions is performed via a very compact control block in which the control is combined to form a unit along with all the essential directional control valves and regulating valves. Such a control block is, for instance, described in the catalogue 1 987 760 507 (electronic-hydraulic lifting gear regulation for tractors) by the Applicant.

FIG. 1, which is referred to now already, illustrates the basic structure of the work hydraulics of a tractor 1 or of some other mobile implement. In accordance with FIG. 1, the tractor 1 is designed with a rear lifting gear 2 and a front lifting gear 4, the lifting cylinders 6, 8 of which can, via a control block 10, be supplied with a pressure medium of a hydraulic pump 12. In the prior art illustrated, the two lifting gears 2, 4 are configured to be single-acting (s-a), but solutions are also known in which both the front lifting gear 4 and the rear lifting gear 2 are configured to be double-acting (d-a). The control block 10 comprises electro-hydraulically actuatable directional control valves 14 that are assigned to each of the loads 6, 8 and that are controlled via an electric control device 16. The set values are, for instance, adjusted via a front operating device 18 or a rear operating device 20 which are positioned in the interior of the tractor cabin 22, or via a rear sensing device 22 positioned at the rear of the tractor, or a front sensing device (not illustrated).

For collecting the forces, pressures, speeds, and lifting gear positions occurring, a plurality of sensors, for instance, pressure sensors 26, torque sensors 28, position sensors 30, force sensors 32, or speed sensors 34, are provided at the tractor 1, the signals of which can be processed by the control device 16.

As has already been mentioned, the rear lifting gear 2 is configured to be single-acting in most known solutions, wherein the lifting cylinder 6 is extended by pressure medium being supplied via the pump 12, and the lowering is performed by the inherent weight of the rear lifting gear 2 and of the device that is mounted thereon as the case may be, e.g. a plough 36.

For drilling with a drilling machine, for instance, the rear lifting gear 2 is placed in a floating position, so that the add-on unit is in contact with the ground due to its inherent weight and passes over possible ground bumps.

With the conventional, single-action rear lifting gears, however, the bearing pressure cannot be changed actively since these lifting gears are not adapted to be operated in the field of work "pressing". To this end, double-action rear lifting gears are required, the basic structure of which corresponds to that of the commonly used double-action front lifting gears. The double-action rear lifting gears 2 enable the lifting cylinder 6 to be controlled in the direction of "pressing", so that an active pulling of the plough is, for instance, possible. This operating state may, for instance, also be used to lift the rear side of the tractor for changing the rear, big wheels, so that it stands on the swinging front axle and on the add-on unit actuated by the rear lifting gear, or directly on the lower hitches.

The hitherto employed pressure sensor e.g. in the front lifting gear is positioned at the bearing side and a relief pressure regulation takes place—the bearing pressure remains unknown or is not used for regulation.

SUMMARY OF THE INVENTION

As compared to this, it is an object of the invention to provide a lifting gear valve arrangement that enables the adjustment and limitation of a bearing pressure with minimum effort.

This object is solved by a lifting gear valve arrangement with the feature of the claims.

In accordance with the invention, the lifting gear valve arrangement comprises a continuously adjustable directional control valve with one or a plurality of upstream or downstream pressure compensators. Two working connections of the lifting gear valve arrangement are connected with the pressure chambers of the lifting gear—or more exactly of the lifting cylinder of the lifting gear—acting in lifting or lowering direction. In accordance with the invention, a—preferably proportionally—adjustable pressure limiting valve or the like is provided in a working line, which enables the pressure in this working line to be limited to a modifiable maximum value. In accordance with the invention, the pressure in this working line is limited via the pressure limiting valve as a function of particular operating states, so that the bearing pressure is correspondingly enabled to be variably adjustable.

The term lifting gear in general means a device via which a working tool, add-on unit, or the like that is assigned to a mobile implement is adapted to be movable vis-à-vis or to be pressed against a reference plane.

This lifting gear valve arrangement that is of very simple construction enables the bearing pressure to be adapted, by controlling the pressure limiting valve, to different operating conditions in an extremely simple and cost-efficient manner.

In a preferred embodiment of the invention, the maximum pressure can be adjusted via the pressure limiting valve in a range between 0 to 250 bars. If a minimum bearing pressure (for instance 5 to 8 bars) is adjusted, the function of the lifting gear designed with the inventive lifting gear valve arrangement equals to that of a single-action lifting gear. In normal operation, the driver adjusts the pressure limiting valve to its maximum value, so that the bearing pressure may correspondingly reach a maximum value.

The adjustment of the maximum pressure is performed as a function of different operating states—for instance, on lifting the rear axle for tire change, on actuation of a quick motion switch for a quickest lowering movement, on actuation of the rear sensing device, etc., wherein appropriate maximum pressures are adjusted in each case. In normal operation, the driver adjusts the maximum pressure.

In the inventive lifting gear valve arrangement, controlling is preferably performed by a control device via which the continuously adjustable directional control valve is adapted to be adjusted in a neutral position (d-a) or a floating position (s-a) on response of the pressure limiting valve.

In a particularly preferred embodiment, a secondary pressure limiting valve is provided for limiting the pressure in the other working line, i.e. preferably in the working line connected with the pressure chamber acting in the direction of "lifting".

In the working lines, downstream of the two outlet connections of the continuously adjustable directional control valve, a respective lowering module is provided which acts as an unlockable check valve in a basic position and as a discharge pressure compensator when impacted with a control pressure.

The inventive lifting gear valve arrangement is preferably designed as LS system, wherein the pressure compensator as an individual pressure compensator is positioned upstream of the continuously adjustable directional control valve that forms a modifiable measuring orifice. The pressure compensator is impacted in opening direction by the highest load pressure of the controlled loads. This highest load pressure is also notified to a pump, and this pump is regulated such that a pump pressure ranging by a predetermined pressure difference above the load pressure is present in the pump line.

The lifting gear valve arrangement may be designed with a hand-operated emergency drain via which the working line having the higher pressure is adapted to be connected with the tank.

The inventive solution is preferably used with a rear lifting gear of a tractor. The use with add-on units, e.g. ploughs, and outside agritechnological applications, e.g. for actuating shields that are, for instance, used with snow ploughs, is also conceivable, though.

Other advantageous further developments of the invention are the subject matters of further subclaims.

BRIEF DESCRIPTION OF THE DRAWINGS

In the following, preferred embodiments of the invention will be explained in more detail by means of schematic drawings. There show.

DETAILED DESCRIPTION OF THE PREFERRED EMBODIMENT

Figure 1:
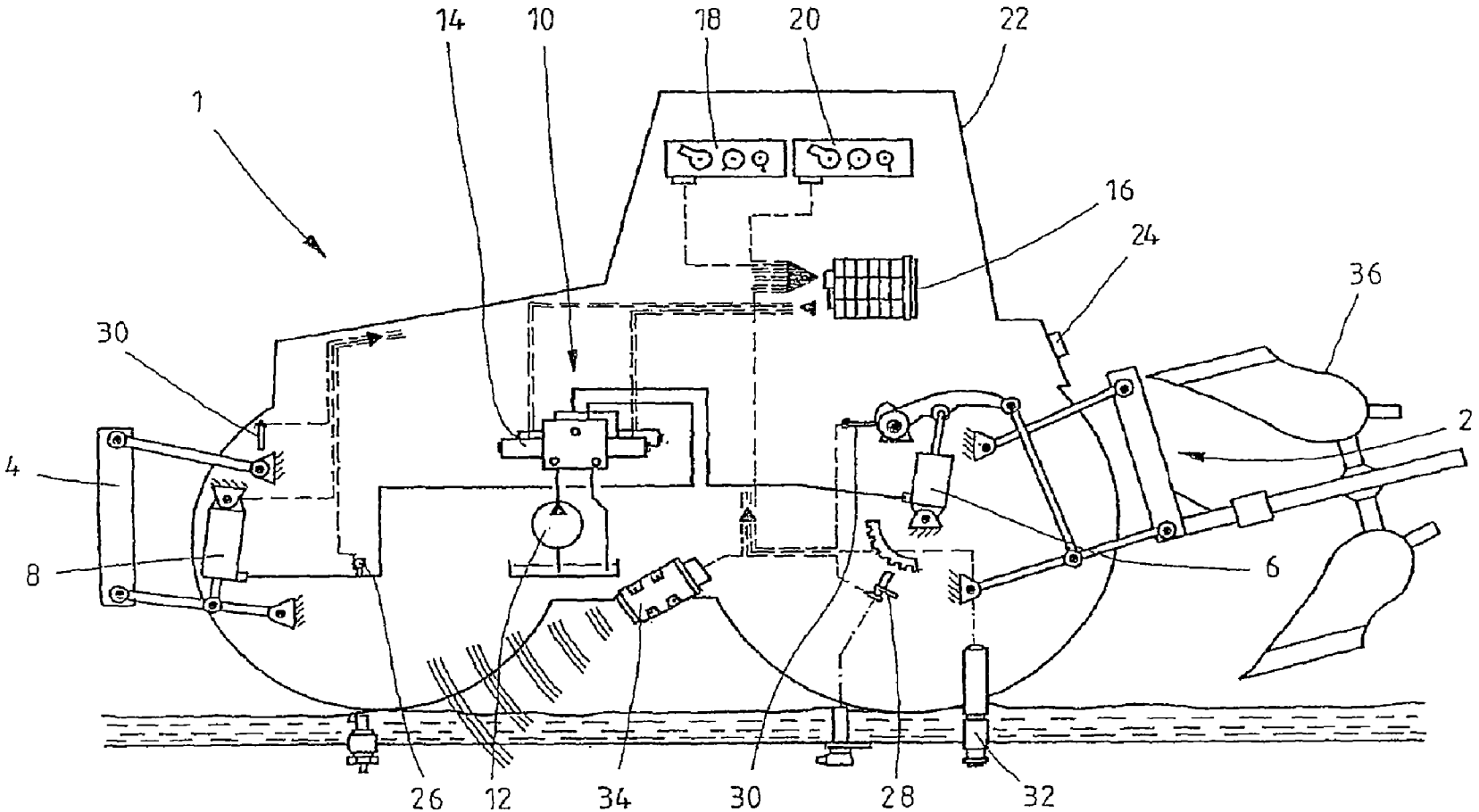
FIG. 1 a basic scheme of the work hydraulics of a conventional tractor.

It is assumed that the tractor 1 illustrated in FIG. 1 comprises a double-action rear lifting gear 2 instead of a single-action one, wherein the pressure medium supply of the two pressure chambers of the lifting cylinder 6 is performed via an inventive lifting gear valve arrangement that is combined to form a control block 10 with the directional control valves for controlling the other loads of the tractor 1.

Figure 2:
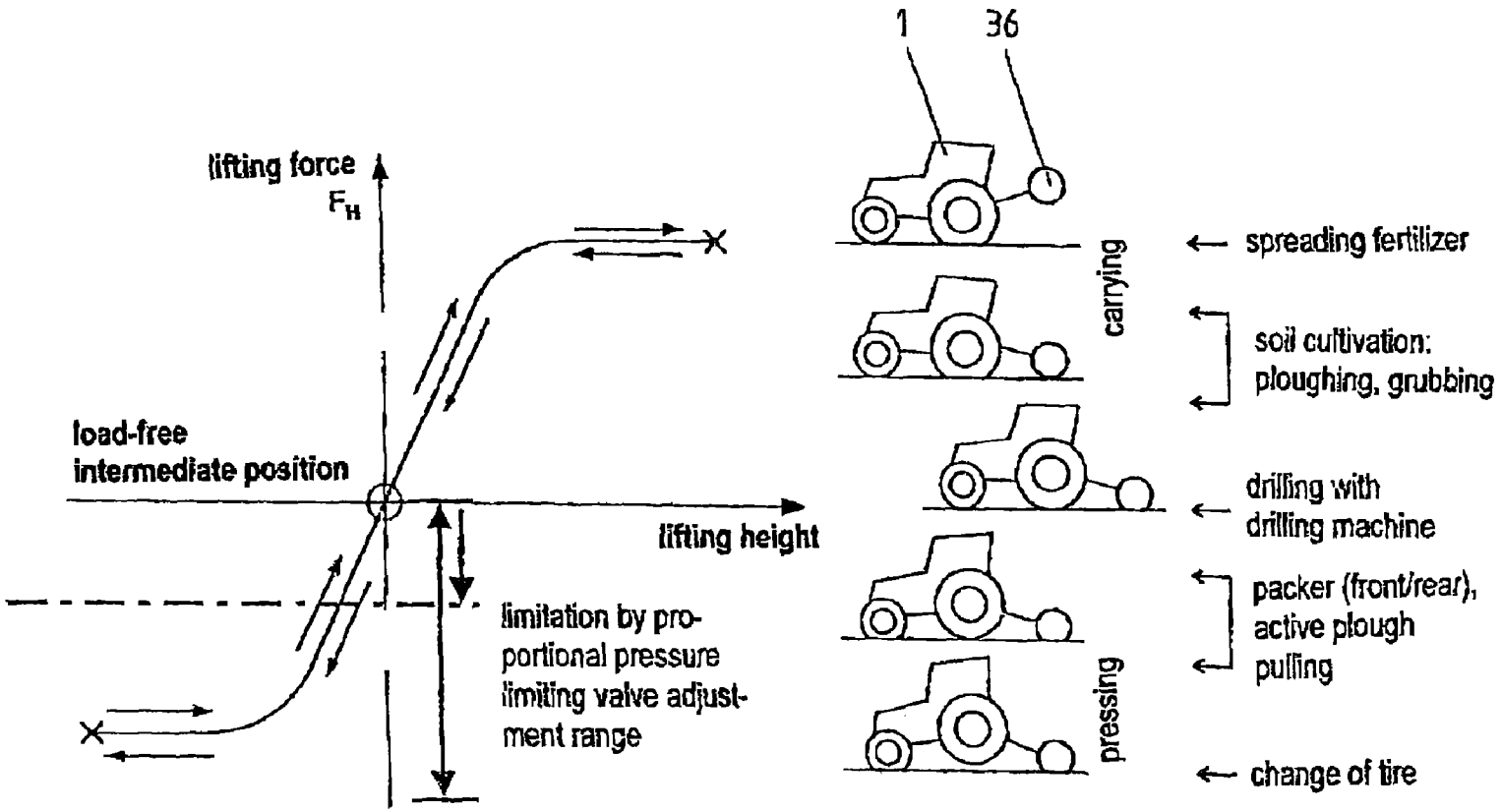
FIG. 2 a schematic representation of different operating states of a double-action rear lifting gear that is designed with an inventive lifting gear valve arrangement.

A rear lifting gear 2 in accordance with FIG. 1 can—as illustrated in FIG. 2—be used in different operating states. In the field of work "carrying", the rear lifting gear and correspondingly add-on units 36 that are actuated by it, as the case may be, are either lifted off the ground or carried in ground contact with a predetermined support force. This field of work exists, for instance, during ploughing or during grubbing.

At the left of FIG. 2, the lifting force characteristics are represented in relation to the lifting height—this lifting force has to be exerted by the lifting cylinder 6 of the rear lifting gear 2. For drilling with a drilling machine, for instance, a load-free intermediate position is assumed in which the rear lifting gear 2 is not impacted with any force, so that the add-on unit bears on the ground due to its inherent weight. Such a load-free intermediate position is usually—as will be described in the following—adjusted by adjusting the directional control valve 44 in a floating position.

As initially mentioned, for adjusting the field of work "pressing", the rear lifting gear 2 can be triggered such that a pressure force acting in the direction of the ground is applied. Such an adjustment is, for instance, necessary during the active pulling of the plough or with a packer. In the field of work "pressing", the rear axle of the tractor 1 may also be lifted, so that a change of tire is possible.

By means of the lifting gear valve arrangement 14 that will be described in more detail in the following, the pressure force active in the field of work "pressing" may be limited to different values, wherein this limit value is varied as a function of operating states that will be described in more detail in the following.

Figure 3:
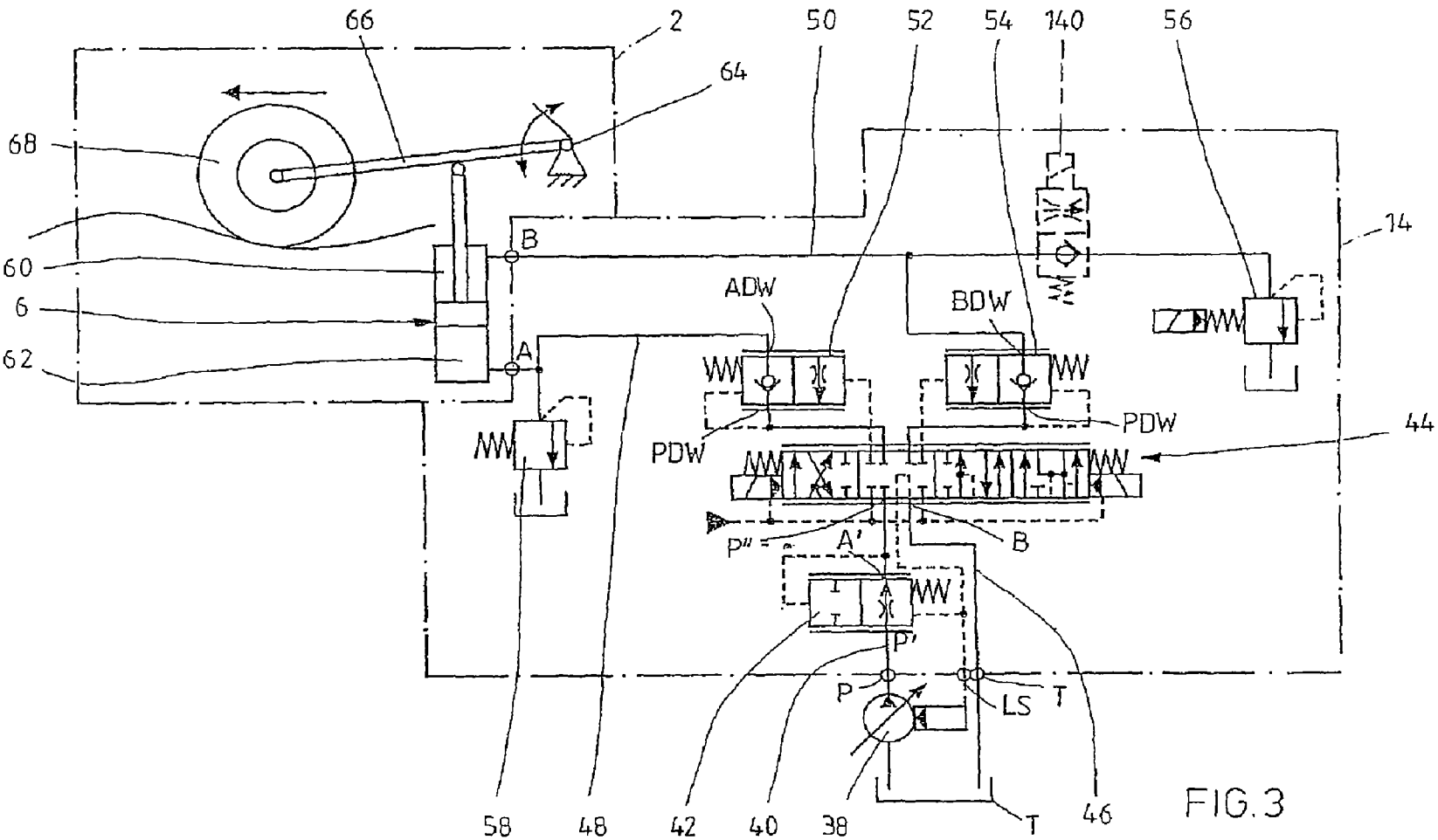
FIG. 3 a hydraulic circuit diagram of the rear lifting gear by which the operating states of FIG. 2 can be adjusted.

FIG. 3 illustrates a circuit diagram of a rear lifting gear 2 that is controlled via an inventive lifting gear valve arrangement 14. This lifting gear valve arrangement 14 is accommodated in a housing designed in plate construction and comprises a pressure connection P, a tank connection T, and two working connections A, B. The pressure connection P is, via a pump line, connected with a variable displacement pump 38, the manometric pressure of which is adjusted as a function of the highest load pressure present at the loads of the tractor 1. This load pressure is tapped at an LS connection. Such an LS control is, however, no prerequisite for the inventive system.

The pressure connection P is, via an inflow channel 40, connected with an input connection P' of an individual pressure compensator 42, the output connection A' of which is connected with an input connection P" of a continuously adjustable directional control valve 44. The reflux connection R thereof is, via a reflux channel 46, connected with the tank connection T of the lifting gear valve arrangement 14. The directional control valve 44 comprises two working connections A" and B" that are, via working channels 48, 50, connected with the two working connections A, B of the lifting gear valve arrangement 14.

In each working channel 48, 50, a respective lowering module 52, 54 is provided which serves, in a basic position, as unlockable check valve for the leaking oil-free clamping of the lifting cylinder 6 of the rear lifting gear 2, and which controls, in a regulating position, the pressure medium volume flow flowing back from the lifting cylinder 6 as a flow-off regulation.

The working channel 50 is, downstream of the lowering module 54, adapted to be connected with the tank connection T via a precontrolled proportionally adjustable pressure limiting valve 56. The pressure in the other working channel 48 is limited via a secondary pressure limiting valve 58. The lifting cylinder 6 is—as mentioned—designed in a double-acting manner, wherein a ring chamber 60 acting in the direction "lowering" is connected with the working connection B, and the pressure chamber 62 acting in the direction "lifting" is connected with the working connection A of the lifting gear valve arrangement 14. Via the lifting cylinder 6, an arm 66 that is pivotally mounted on a drive shaft 64, and further coupling elements are actuated, at which, for instance, an add-on unit such as a drilling machine or a plough 68 are mounted.

Figure 4:
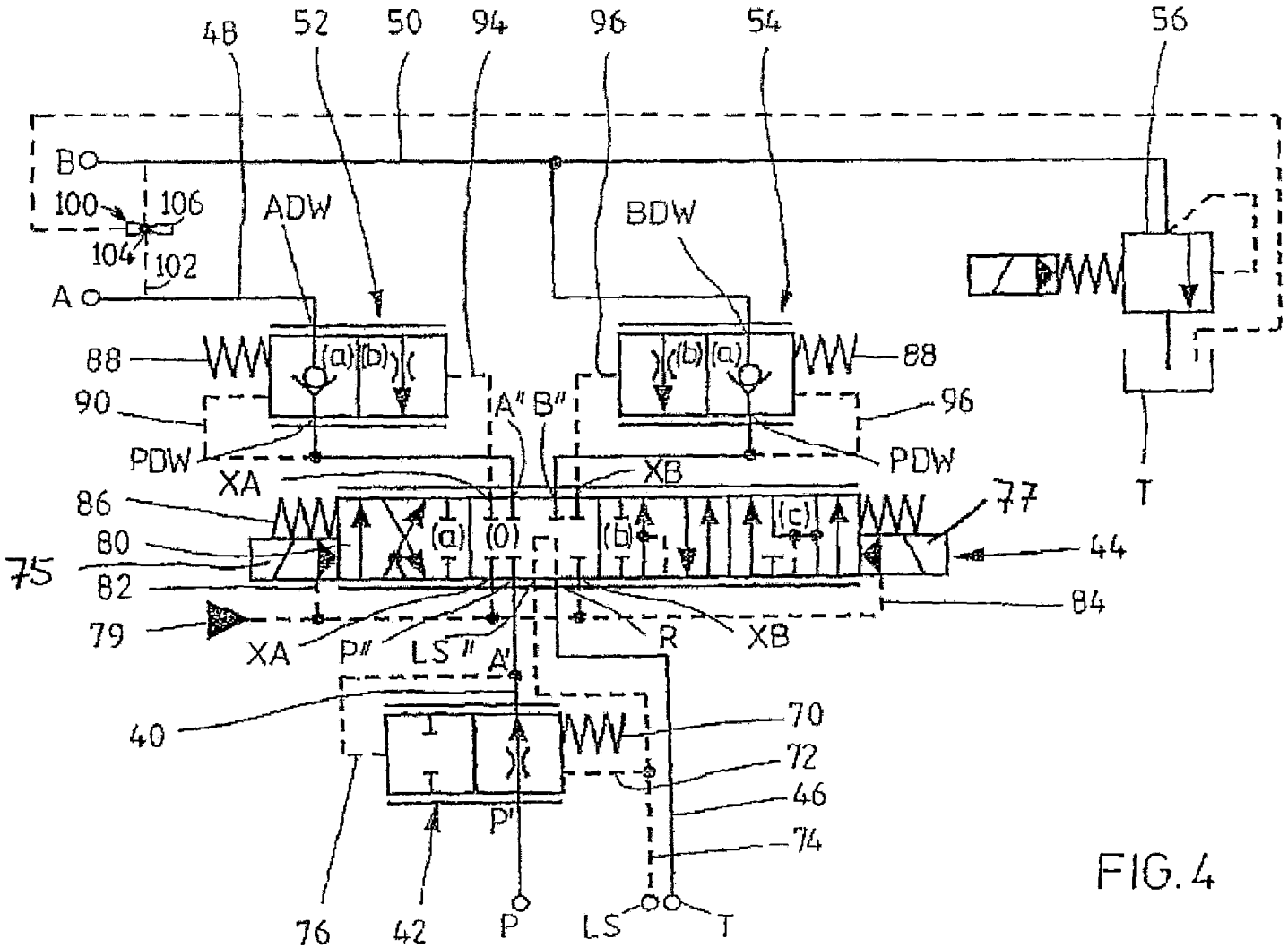
FIG. 4 a detailed representation of the lifting gear valve arrangement of FIG. 3.

Details of the lifting gear valve arrangement 14 are explained by means of the enlarged representation of FIG. 4.

A pressure compensator piston 69 of the pressure compensator 42 is impacted by a pressure compensator spring 70 and by the pressure tapped via a channel 72 by a load notifying channel 74 connected with the LS connection, in opening direction, and by the pressure in a control channel 76 in closing direction, which branches off the inflow channel 40 between the pressure compensator 42 and the directional control valve 44. The LS channel 74 leads to a control connection L" of the directional control valve 44. This directional control valve 44 comprises to more control connections X, to the output sides of which control connections XA and XB are assigned.

Figure 5:
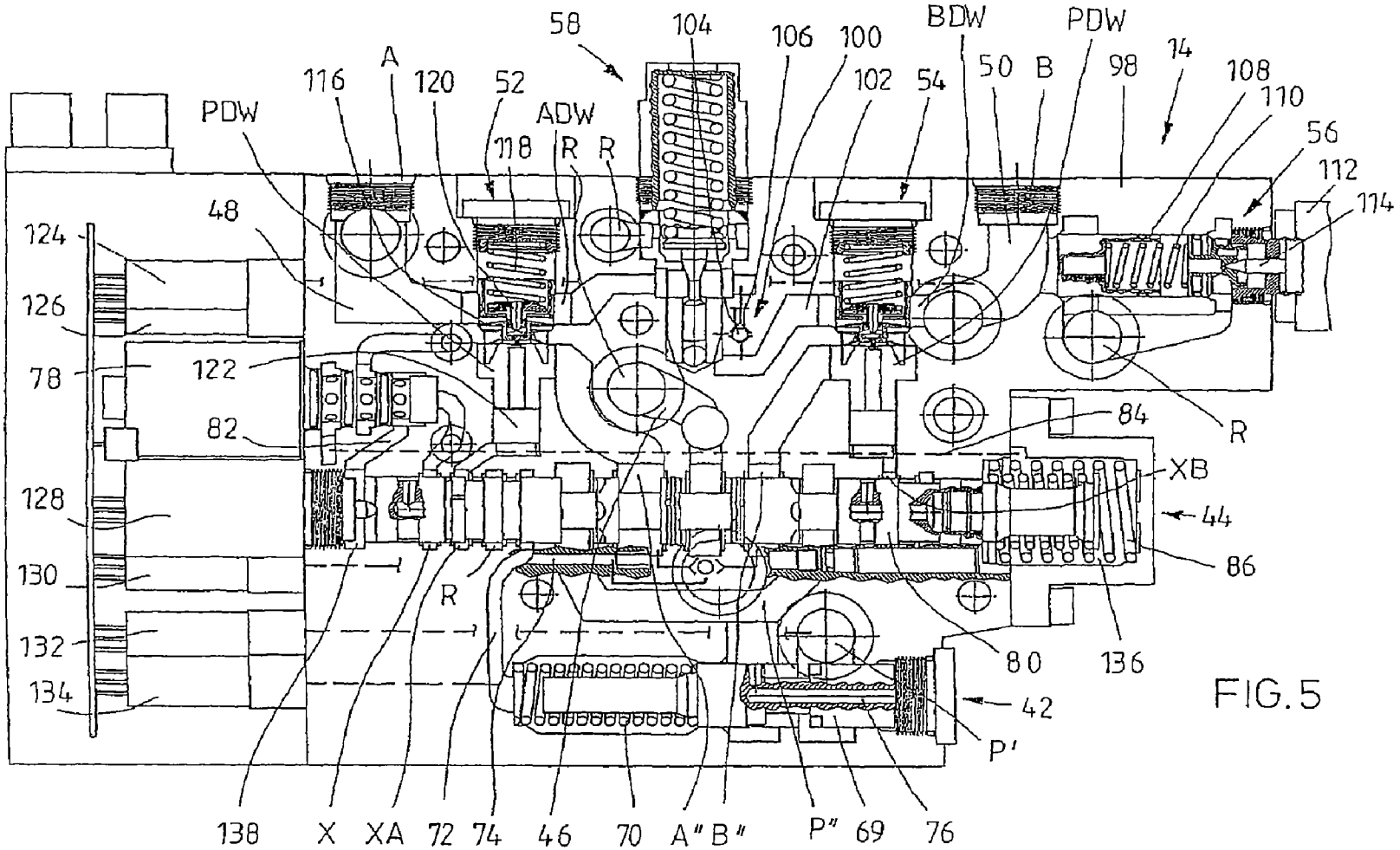
FIG. 5 a sectional representation of a lifting gear valve arrangement used in the circuit of FIG. 3.

The actuation of the directional control valve 44 is performed via a pilot valve 78 illustrated in FIG. 5, or via a pilot valve arrangement which is, in the representation according to FIG. 4, designed by two electrohydraulic pilot control elements 75, 77. The triangle 79 indicates the pressure supply of these pilot control elements 77, 75. Via the pilot valve 78 or the pilot control elements 77, 75, respectively, control oil is enabled to be supplied to a respective control chamber of the directional control valve 44 until a valve shifter 80 has assumed a work position. This work position is collected via a displacement transducer 128. As soon as the desired position has been reported by the displacement transducer 128, the pilot control element 77, 75 is again placed in its neutral position. The position of the valve shifter 80 is maintained in a regulated manner in that the pilot control elements 77, 75 are controlled in correspondence with the signal of the displacement transducer 128. The pilot control elements 77, 75 are connected with the pressure supply 79 via the control lines 82 or 84, respectively. The valve shifter 80 is, via a centering spring arrangement 86, prestressed in its illustrated basic position (0) in which the LS channel 74 is connected with the tank channel 46 and all the other afore-mentioned connections are locked.

The valve bodies of the two lowering modules 52, 54 are each impacted by a spring 88 and by the individual load pressure tapped at the output A" or B" via pressure compensator channels 90, 92 downstream of the directional control valve 44 in their basic position (a) in which the lowering modules 52, 54 act as check valves that permit a pressure medium flow to the connections A, B. In opening direction, the valve bodies of the lowering modules 52, 54 are each impacted by the control pressure present at the connection XA or XB, which is tapped via an unlock channel 94, 96. This control pressure may, for instance, correspond to the input pressure of the pilot valve arrangement 78.

The construction of the lifting gear valve arrangement with the individual pressure valve 42, the continuously adjustable directional control valve 44, and the lowering modules 52, 54 downstream to both of them corresponds substantially to the conventional solution of the valve SB23 LS, so that only the elements that are essential for understanding the invention will be described in the following, and the available prior art with respect to the directional control valve SB23 LS is referred to for the rest.

If, for instance, the lifting cylinder 6 is to be moved for lifting the plough 68, the valve shifter 80 of the directional control valve 44 is, via the pilot valve arrangement 78, shifted to one of its regulation positions designated with (b). Depending on the position, a measuring orifice that is positioned downstream of the individual pressure compensator 42 is opened. Depending on the opening of the measuring orifice, the pressure compensator 42 adjusts itself in a regulation position in which the pressure drop across the measuring orifice is kept constant and thus a load pressure-independent pressure medium volume flow is adjusted. This pressure medium volume flow is guided in the regulation positions designated with (b), via the pressure compensator 42, the pressure connection P", and the output connection A" of the directional control valve 44, to the input connection PDW of the lowering module 52, and via the output connection ADW thereof, to the working connection A of the lifting gear valve arrangement 14, and from there to the ground-side pressure chamber 62—the lifting cylinder extends. The pressure medium displaced from the ring chamber 60 flows, via the working connection B of the lifting gear valve arrangement 14, the working channel 50, the output connection BDW, and the input connection PDW of the lowering module 54, to the connection B" of the directional control valve 44, and from there, via the reflux connection R, the tank channel 46, and the tank connection T, back to the tank. This reflux is enabled in that the input pressure that is present at the pilot valve arrangement 78 is tapped via the control connection X and the output connection XB of the directional control valve 44 and impacts the valve body in opening direction via the unlock channel 96, so that the lowering module 54 unlocks and enables the reflux of the pressure medium toward the tank T. In these positions of the lowering module 54 which are designated with (b), it acts as discharge pressure compensator via which the discharging pressure medium volume flow is regulated in a certain scope.

For pressing on an add-on unit carried by the lifting gear, the directional control valve 44 is shifted to one of its regulation positions designated with (a), so that the pressure medium supply is correspondingly performed via the lowering module 54 in its check valve function to the ring chamber 60, while the pressure medium flowing off the ground-side pressure chamber 62 flows off toward the tank via the unlocked lowering module 52 and the directional control valve 44. The unlocking is performed by the control pressure that is guided via the control connections X, XA of the directional control valve 44 and the unlock channel 94 to the control face of the lowering module 52 which is acting in opening direction.

For load-free bearing, the directional control valve 44 is moved to its floating position (final position c) in which both lowering modules 52, 54 are unlocked and moved to their transit position designated with (b), and the working connections A, B and the control connection LS are connected with the tank connection T, and the input connection P" is locked.

In the field of work "pressing"—as will be explained in more detail in the following—the maximum pressure in the working channel 50 is limited, by a suitable adjustment of the proportionally adjustable directional control valve 44, to a value between, for instance, 0 to 250 bars.

FIG. 5 shows a section through a valve plate by which the lifting gear valve arrangement 14 is realized. The valve plate comprises a plate-shaped housing 98 into which the pressure compensator 42, the directional control valve 44, the two lowering modules 52, 54, the pilot valve 78, the secondary pressure limiting valve 58, and the proportionally adjustable pressure limiting valve 56 are integrated.

The valve plate 98 illustrated in FIG. 5 further comprises a hand-operated emergency drain valve 100 that is illustrated schematically only, via which the working channels 48 and 50 are adapted to be connected with the tank T.

In the solution illustrated in FIG. 5, the emergency drain valve 100 is positioned in a connection channel 102 between the working channels 48, 50. It comprises a ball 104 that is, via a grub screw that can be accessed from outside, prestressed in a closing position in which a connection to the tank channel 46 and thus to the reflux connection R is locked. By releasing the grub screw 106, the ball 104 that was clamped before becomes free and is therefore, by the higher pressure in the working channel 48 or 50, enabled to be placed in an opening position in which the connection to the tank channel 46 is opened—the pressure medium may be drained from the pressurized working channel 48 or 50.

Via the secondary pressure limiting valve 58, the pressure in the working channel 48 (connection A) is limited to a maximum pressure adjusted below the pump pressure. The construction of such secondary pressure limiting valves is known, so that further explanations are dispensable. The construction of the precontrolled proportionally adjustable pressure limiting valve 56 is also known per se—a piston 108 of the pressure limiting valve 56 is, via a weak pressure spring 110 and by the pressure in the spring chamber, pressed against a valve seat in a closing position. The pressure in the spring chamber is limited by the force exerted on a closing cone 114 by means of a proportional magnet 112.

The controlling of the proportional magnet 112 is performed by the control device 16 in the way described in the following.

The lifting and lowering modules 52, 54 are also of common structure, wherein a module piston 116 is prestressed in a closing position via a closing spring 118. The spring chamber of the closing spring 118 is impacted by the pressure in the working channel 48 or 50 in the closing position of the module piston 116. In the bottom of the module piston 116, a pilot valve body 120 is arranged which is prestressed in its closing position via the closing spring 118, too, and thus closes a pilot opening. The pilot valve body 120 comprises a projection that is adapted to be brought in abutment to a push-open piston 122. The rear side of this push-open piston can be impacted with the pressure at the control connection XA (XB) which can be tapped via the directional control valve 44 and its connection X. This means that, on impacting the push-open piston 122 of the lowering module 52 or 54, the pilot valve body 120 is lifted off its pilot seat against the force of the closing spring 118—the module piston 116 is then pressure-balanced and can be lifted off its seat by the push-open piston 122 against the force of the closing spring 118, so that pressure medium can flow off the working connection A or B toward the tank T.

Reference numbers 124, 126, 130, 132, 134 designate pressure sensors by which the pressures in the working channels 48, 50, the pressure at the pressure connection P, the load pressure, and other pressures can be collected.

The pilot valve 78 according to FIG. 5 is designed as a 4/3-way valve, with its output connections being connected to the control lines 82 or 84, respectively, which are guided to the front-side control chambers 136 or 138, respectively, of the directional control valve 44. At the left front face—in FIG. 5—of the valve shifter 80 of the directional control valve 44, a displacement transducer 128 is positioned, by which the valve shifter lift can be collected.

Since—as mentioned—the basic structure of the lifting gear valve arrangement 14 according to FIG. 5 is—apart from the pressure limiting valve 56, the emergency drain 106, and the positioning of the secondary pressure limiting valve 58 as well as the pressure sensors 124, 126, 130, 132, 134—already known from the known valve SB23 LS, the description of further constructional details of the afore-described valve components may be omitted.

For adjusting the field of work "pressing", the pilot valve 78 is controlled such that a control pressure difference is effective in the control chambers 136, 138, by which the valve shifter 80 is shifted to the left from the spring-prestressed basic position illustrated in FIG. 5, so that pressure medium is conveyed from the pressure connection P via the pressure compensator 42, the branching input connection P" of the directional control valve 44, its output connection B", the lowering module 54 opening in its function as a check valve, and the working channel 50, to the working connection B, and from there to the ring chamber 60. The pressure medium displaced from the bottom-side pressure chamber 62 is returned via the working connection A, the lowering module 52 unlocked in the afore-described manner, the connection A" of the directional control valve 44, the tank channel 46, and the reflux connection R to the tank T. The maximum bearing pressure is limited, by an appropriate adjustment of the pressure limiting valve 56, to a value predetermined as a function of the add-on unit used, or as a function of the assignment of tasks for the rear lifting gear 2.

A control valve 140 may, in accordance with FIG. 4, be connected upstream or downstream of the pressure limiting valve 56, said control valve 140 being adapted to be moved in a throttle position by a magnet, so that the pressure medium is prevented from flowing off to the tank via the pressure limiting valve 56. The control valve 140 is actuated if the bearing pressure is to be adjusted to a value above the value adjustable at the pressure limiting valve 56 (e.g. during change of tire).

In the following, the control concept of the lifting gear control is explained by means of different operating states.

As a rule, the rear lifting gear is operated in a double-acting manner. The pressure sensors 124, 126, 130, 132, 134 enable a position/traction regulation, wherein the function is, however, also guaranteed without this pressure collection since a protection in the field of work "pressing" is possible via the pressure limiting valve 56. When using the stage with the pressure sensors 124, 126, 130, 132, 134 as illustrated in FIG. 5, the bearing pressure/release pressure can be regulated via the pressure sensors. The protection in the field of work "pressing" is then again performed via the pressure limiting valve 56, wherein the latter is then automatically adjustable as a function of the bearing pressure/release pressure. The basic concept of the inventive control is explained by means of the stage without pressure sensors as illustrated in FIG. 3—this basic concept can also be used in the stage illustrated in FIG. 5, with the substantial difference vis-à-vis the solutions without pressure sensors consisting in that the adjustment of the pressure limiting valve 56 is performed as a function of the adjusted bearing pressure that is to be regulated via the pressure regulation by means of the pressure sensors. As will be explained in the following, both stages enable the rear lifting gear to be operated both in a double-acting manner and in a single-acting manner.

1. Basic Function

It is assumed that the rear lifting gear 2 is to be operated in the field of work "pressing" (see FIG. 2) so as to pull a plough, for instance. The driver generates, by adjusting at the rear operating device 20 or at some other operating device, an input signal by which the directional control valve 44 is shifted to the right (FIG. 4) in one of its lowering positions designated with (a). Simultaneously, the maximum bearing pressure in the working channel 50 is limited by an appropriate adjustment of the pressure limiting valve 56. This maximum bearing pressure may vary as a function of the implement adhered or—as described in the following—as a function of particular operating states. It is assumed that the pressure limiting valve 56 is adjusted to a pressure of 50 bars. The pressure medium volume flow is supplied to the ring chamber 60 of the lifting cylinder 6 via the working connection B, and returned from the bottom-side pressure chamber 62 via the open drain module 52 and the directional control valve 44 to the tank T—the rear lifting gear 2 is lowered and, for instance, the plough is pulled. This lowering is performed in accordance with the regulation predetermined by the control device 16, e.g. a position regulation. On reaching a predetermined maximum bearing pressure—i.e. on exceeding the adjusted maximum pressure of, for instance, 50 bar in the working channel 50, the pressure limiting valve 56 opens and the pressure medium does not flow off any longer via the working connection B to the lifting cylinder 6, but toward the tank T—the rear lifting gear 2 stops, with the operating device 20 still being adjusted to "lowering". From the "stopping" of the rear lifting gear 2 the driver recognizes that the desired, preadjusted bearing pressure (50 bars) has been reached—the directional control valve 44 may also be switched neutral, so that this adjusted, non-regulated pressure is maintained. Since this pressure may vary due to ground bumps, etc., or due to external forces, a motion control is performed in the field of work "pressing". This control concept will be explained by means of FIG. 6.

Figure 6:
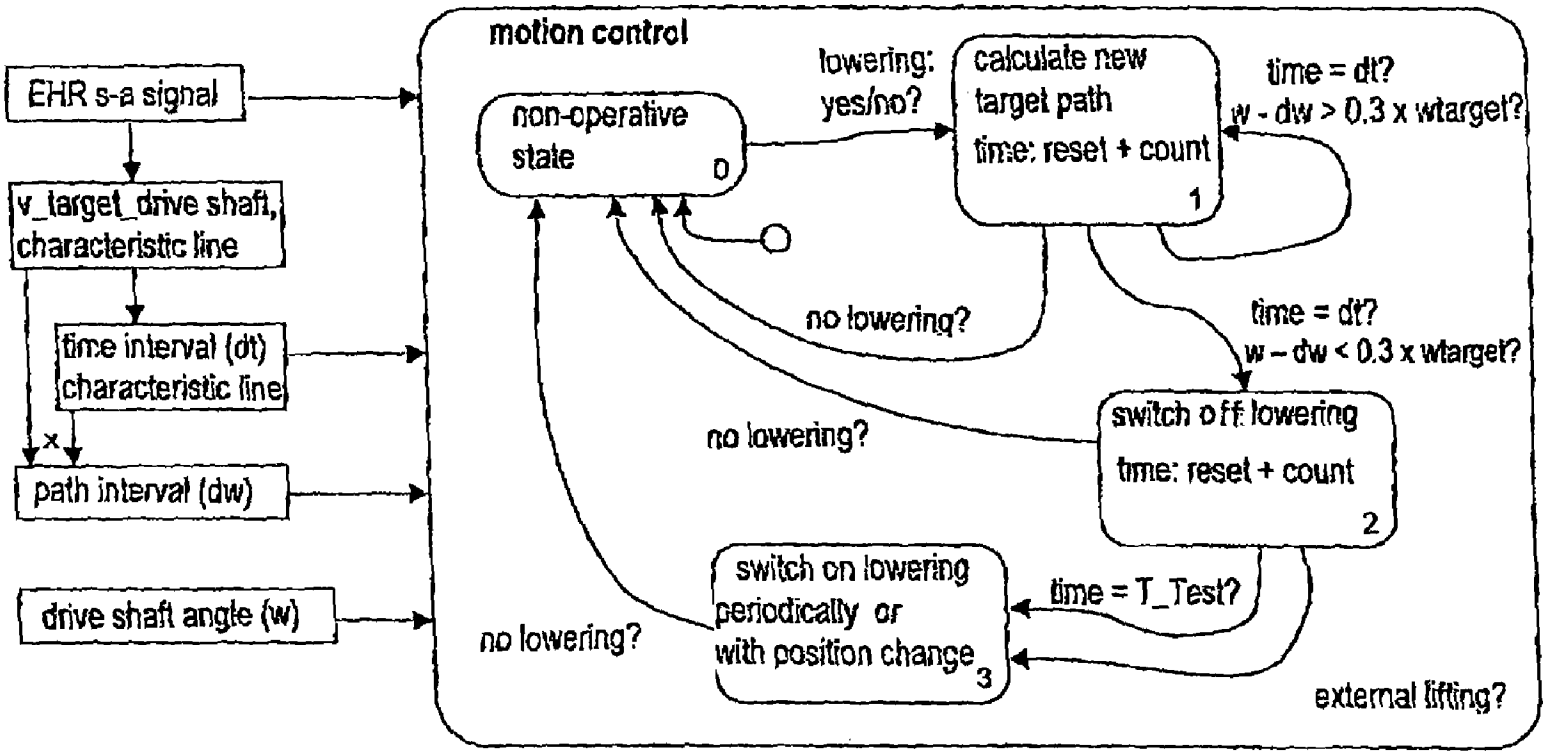
FIG. 6 a diagram for illustrating the control structure for controlling the lifting gear valve arrangement of FIG. 3.

In accordance with FIG. 6, the system is first of all non-operative, i.e. the driver has not yet switched to the field of work "lowering". After switching to lowering, the path and the time intervals for the motion control are first of all calculated. A plurality of possibilities exist therefor, and only two methods have been selected as examples. In the solution illustrated in FIG. 6, on the basis of the input signal output by the control device 16 to the directional control valve 44 or the pilot valve 78, respectively, the expected, normal lifting gear speed v is determined by means of a characteristic diagram stored in the memory of the control device 16. By means of a further characteristic diagram, a suitable path interval dw is calculated from this lifting gear speed v. A control time interval dt is then determined from the quotient dw/v. The known characteristic diagrams are matched such that a path interval dw as constant as possible of approx. 1/30 of the total lift results in the main field of work "pressing". As long as the path determined supports at least approx. 90 percent of the aforementioned path interval (1/30 of the total lift) during the time interval calculated, the control recognizes that the rear lifting gear 2 is still being lowered. If the rear lifting gear 2 moves by less than 10 percent of the path interval calculated (1/30 of the total lift) during the time interval, the control recognizes that the rear lifting gear 2 "stops"—the directional control valve 44 is adjusted to its neutral position (0).

In the case in which a lowering target signal by the electrohydraulic lifting gear regulation is still present (target position has not yet been reached) and—as described above—the lowering movement is switched off (directional control valve 44 in neutral position (0)), a motion control mode is switched to. To this end, a "pressure measurement" is performed during a predetermined time interval that need not be identical to the initially described time interval for collecting the state "stopping". To this end, the directional control valve 44 is again adjusted to one of its "lowering" positions (a), i.e. a lowering movement is activated by a predetermined ramp so as to perform "pressure measuring". Thus, the rear lifting gear 2 is lowered and may adapt to the current ground situation. After this lowering movement, the directional control valve 44 is readjusted to the neutral position (0)—the control is performed until the operating device 20 has withdrawn the lowering signal.

In the case in which an upward lifting gear movement is performed due to external forces (e.g. driving over ground bumps), the afore-described new lowering movement is started immediately after the occurring of this upward lifting gear movement, wherein this may take place independently of the adjusted time interval (for instance, 5 seconds). After withdrawal of the lowering signal, the system is again in its non-operative state illustrated at the left in FIG. 6.

In the afore-described control concept, the time and path intervals are determined from characteristic diagrams. In a simplified solution, instead of this relatively complex method of determining the time and path intervals from characteristic diagrams, the lifting gear speed may also be used, which is anyway collected in the scope of the electrohydraulic regulation (for instance, by the sensor 30). A "stopping" of the rear lifting gear 2 is then recognized if the lowering speed underruns a minimum speed during a predetermined time interval. This means, instead of a path interval, the lifting gear speed is directly evaluated.

2. Single-Acting Function of the Rear Lifting Gear

As mentioned, the rear lifting gear may also be operated in a single-acting manner. To this end, the pressure of the pressure limiting valve 56 is adjusted to a minimum value, for instance, 5 to 8 bar, so that a minimum pressure is adjusted at the working connection B and thus in the ring chamber 60 of the lifting cylinder 6. If a lowering signal is now output via the electrohydraulic lifting gear regulation (EHR) and the afore-described motion control is activated since the actual change of path of the lifting gear (drive shaft angle) is less than 10 percent of the expected change of path per time unit (or the lifting gear speed is below the limit value), the directional control valve 44 is not adjusted to the neutral position (0) as in the double-acting function, but to the floating position (c)—the lifting gear is enabled to adapt to possible bumps of the ground. The adjusted behavior corresponds to that of conventional single-acting lifting gear valves.

3. Rapid Motion

For actuating rapid motion, a rapid motion switch is actuated, so that the rear lifting gear is lowered in a double-acting manner at maximum speed until the bearing pressure adjusted at the pressure limiting valve 56 has been reached. On reaching this bearing pressure, the directional control valve 44 is, in contrast to the afore-described basic function, not switched to its neutral position (0), but remains in its lowering position (a), so that the rear lifting gear 2 may immediately follow a further lowering movement.

For the case that the driver actuates the rapid motion switch for a lengthy time (longer than 10 seconds, for instance) and the rear lifting gear 6 stops during this period, the directional control valve 44 is adjusted to its neutral position (0) so as to avoid an unnecessary heating of the pressure medium.

During the actuation in lowering direction, the pump of the work hydraulics is possibly in the saturation range, i.e. no other load can possibly be actuated.

4. Rear Sensing Device

On actuation of the rear sensing device 24 (FIG. 1), the pressure limiting valve is—preferably automatically—adjusted to a comparatively low pressure of 5 bar, for instance. The lift of the rear lifting gear 2 is performed with a predetermined load-compensated speed, wherein the speed may be increased after a ramp as a function of the path. In this operating mode, a sensitive coupling/uncoupling of the add-on units is possible. The empty lifting gear can be lowered quickly.

5. Lift Tractor

As initially explained, it is desired, for instance, for changing tires, to lift the rear axle of the tractor by means of the rear lifting gear 2, so that the tractor 1 stands on the swinging front axle and an add-on unit that may not be steadfast, so that considerable danger of tilting is given. To reduce this danger, the maximum bearing pressure is limited to a comparatively low pressure of 50 bars, for instance—a change of tire is then not possible offhand.

For change of tire, the pressure of the pressure limiting valve 56 has to be increased, wherein this mode can be adjusted after several inquiries only, so that a deliberate limitation of operation exists. By means of these safety inquiries it may, for instance, be checked whether the stop brake is activated, the necessary pressure at the pressure limiting valve (250 bar) is adjusted, or the control valve 140 is shifted to its locking position if the maximum pressure of the pressure limiting valve 56 is not sufficient (50 bar).

By the afore-described control concepts in cooperation with the lifting gear valve arrangement, the rear lifting gear 2 can be controlled with high precision and operating safety in the field of work "pressing" with a very low effort with respect to regulation technology and device technology.

Instead of the afore-described adjustable pressure limiting valve 56, a permanently adjusted pressure limiting valve may also be used, this, however, entailing a loss of comfort.

Disclosed is a lifting gear valve arrangement for controlling a double-action lifting gear or an add-on unit with a continuously adjustable directional control valve and with an individual pressure compensator via which a pressure medium volume flow to and from a lifting cylinder of the lifting gear can be controlled. A proportionally adjustable pressure limiting valve is provided in the pressure medium flow path between an outlet connection of the directional control valve and a working connection of the lifting gear valve arrangement, via which the pressure inside this area can be limited to a maximum value. The adjustment of the pressure limiting valve is preferably performed as a function of the operating states of the lifting gear or of the type of add-on unit.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

The invention claimed is:

1. A lifting gear valve arrangement for controlling a double-action lifting gear or an add-on unit of an agricultural commercial vehicle, comprising a continuously adjustable directional control valve having a neutral position, the directional control valve forming a metering aperture to which an individual pressure compensator is assigned, via which a pressure medium volume flow flows to a working connection, wherein pressure medium flowing back via another working connection flows off to a low pressure or tank connection via the directional control valve;

a pressure limiting valve fluidly connected to a working channel between the directional control valve and the working connection, wherein said pressure limiting valve is designed to be adjustable, so that the pressure in said working channel is adapted to be limited to different maximum values as a function of different operating states; and a control device moving the directional control valve to the neutral position based on response of the pressure limiting valve.

2. The lifting gear valve arrangement according to claim 1, wherein said pressure limiting valve is arranged in the working channel that is connected with a pressure chamber of said lifting gear or of said add-on unit which is acting in the direction of "lowering".

3. The lifting gear valve arrangement according to claim 1, wherein said pressure limiting valve is adjustable to values between 0 and 250 bar.

4. The lifting gear valve arrangement according to claim 1, wherein the maximum pressure is differently adjustable as a function of different setpoint devices/operating devices.

5. The lifting gear valve arrangement according to claim 1, wherein a secondary pressure limiting valve is fluidly connected to a second working channel.

6. The lifting gear valve arrangement according to claim 1, wherein one lowering module each is arranged in said working channels for the leaking oil-free blocking of the pressure medium.

7. The lifting gear valve arrangement according to claim 6, wherein said lowering module is designed as a drain pressure compensation that is adjustable in a flowthrough position by a control pressure.

8. The lifting gear valve arrangement according to claim 1, wherein said individual pressure compensator is connected upstream of said directional control valve and is impacted in opening direction by the highest load pressure and the force of a pressure compensator spring, and in closing direction by the pressure upstream of said directional control valve.

9. The lifting gear valve arrangement according to claim 1, wherein the lifting gear is a rear lifting gear or a front lifting gear of a tractor.

10. The lifting gear valve arrangement according to claim 1, comprising a control valve connected upstream of said pressure limiting valve.

11. The lifting gear valve arrangement according to claim 1, wherein said pressure limiting valve is proportionally adjustable.

12. A lifting gear valve arrangement for controlling a double-action lifting gear or an add-on unit of an agricultural commercial vehicle, comprising a continuously adjustable directional control valve having a floating position, the directional control valve forming a metering aperture to which an individual pressure compensator is assigned, via which a pressure medium volume flow flows to a working connection, wherein pressure medium flowing back via another working connection flows off to a low pressure or tank connection via the directional control valve;

a pressure limiting valve fluidly connected to a working channel between the directional control valve and the working connection, wherein said pressure limiting valve is designed to be adjustable, so that the pressure in said working channel is adapted to be limited to different maximum values as a function of different operating states; and a control device moving the directional control valve to the floating position based on response of the pressure limiting valve.

13. The lifting gear valve arrangement according to claim 12, wherein said pressure limiting valve is arranged in the working channel that is connected with a pressure chamber of said lifting gear or of said add-on unit which is acting in the direction of "lowering".

14. The lifting gear valve arrangement according to claim 12, wherein said pressure limiting valve is adjustable to values between 0 and 250 bar.

15. The lifting gear valve arrangement according to claim 12, wherein the maximum pressure is differently adjustable as a function of different setpoint devices/operating devices.

16. The lifting gear valve arrangement according to claim 12, wherein a secondary pressure limiting valve is fluidly connected to a second working channel.

17. The lifting gear valve arrangement according to claim 12, wherein one lowering module each is arranged in said working channels for the leaking oil-free blocking of the pressure medium.

18. The lifting gear valve arrangement according to claim 17, wherein said lowering module is designed as a drain pressure compensation that is adjustable in a flowthrough position by a control pressure.

19. The lifting gear valve arrangement according to claim 12, wherein said individual pressure compensator is connected upstream of said directional control valve and is impacted in opening direction by the highest load pressure and the force of a pressure compensator spring, and in closing direction by the pressure upstream of said directional control valve.

20. The lifting gear valve arrangement according to claim 12, comprising a control valve connected upstream of said pressure limiting valve.

* * * * *